US006047849A

United States Patent [19]

Schwegman et al.

[11] Patent Number: 6,047,849

[45] Date of Patent: Apr. 11, 2000

[54] LARGE-CAPACITY BEVERAGE CUP

[75] Inventors: Jeff D. Schwegman; David J. Jochem, both of Evansville, Ind.

[73] Assignee: Berry Plastics Corporation, Evansville, Ind.

[21] Appl. No.: 09/105,587

[22] Filed: Jun. 26, 1998

[51] Int. Cl.[7] ..... B65D 25/22

[52] U.S. Cl. ..... 220/737; 220/675; 220/771

[58] Field of Search ..... 220/674, 675, 220/672, 755, 770, 771, 23.83, 23.86, 737, 738, 739, 740, 914; 215/382, 383, 384; 229/400, 401, 402, 403, 404, 405; 224/148.6, 148.4, 926

[56] References Cited

U.S. PATENT DOCUMENTS

| | | | |
|---|---|---|---|
| D. 188,614 | 8/1960 | Niclaus . | |
| D. 222,961 | 2/1972 | Edwards | 229/400 |
| D. 353,972 | 1/1995 | Robling et al. . | |
| D. 379,738 | 6/1997 | Liming et al. . | |
| 3,186,850 | 6/1965 | Anthony | 229/404 |
| 4,102,454 | 7/1978 | Karevaara | 229/402 |
| 4,551,366 | 11/1985 | Maruhashi et al. . | |
| 4,813,558 | 3/1989 | Fujiyoshi . | |
| 5,344,040 | 9/1994 | Schaeppi | 220/737 |
| 5,383,558 | 1/1995 | Wilkinson et al. | 220/675 |
| 5,427,269 | 6/1995 | Willbrandt . | |
| 5,433,337 | 7/1995 | Willbrandt . | |
| 5,465,891 | 11/1995 | Bridges | 220/738 |
| 5,657,897 | 8/1997 | Schwartzburg . | |
| 5,746,339 | 5/1998 | Petre et al. | 220/672 |

FOREIGN PATENT DOCUMENTS

| | | | |
|---|---|---|---|
| 1429226 | 2/1969 | Germany | 220/738 |

*Primary Examiner*—Stephen Castellano
*Attorney, Agent, or Firm*—Barnes & Thornburg

[57] ABSTRACT

A beverage cup comprises a large-diameter tall main body providing a large capacity, a narrow-diameter short base adapted to be received in a vehicle cup holder, and a neck connecting the main body to the base to define a beverage-receiving cavity. The neck has a circumferential finger-receiving groove configured and positioned to receive a user's finger when the user grasps the cup to remove it from the cup holder.

11 Claims, 3 Drawing Sheets

LARGE-CAPACITY BEVERAGE CUP

BACKGROUND AND SUMMARY OF THE INVENTION

The present invention generally relates to beverage cups, and particularly to beverage cups providing a large capacity. More particularly, this invention relates to cups that can hold large quantities of beverage, yet fit securely in a standard vehicle cup holder.

It is common practice for automobiles and other vehicles to be equipped with built-in cup holders which are typically of a size to receive a conventional twelve ounce aluminum can, about 2½ inches in diameter. Although this type of cup holder is satisfactory to accommodate a standard twelve ounce beverage can in a stable manner, certain beverage cups are too large to fit in these vehicle cup holders. For example, it is common for fast food restaurants to sell large-sized drinks in sizes of twenty ounces or more and, in some cases, as large as forty-six ounces. These larger beverage cups have a diameter much greater than 2½ inches. These cups must be either held by the driver in his hand while driving the vehicle, or placed somewhere in the vehicle where they are likely to spill their contents.

There have been cups that have a relatively small-diameter bottom portion to fit into a conventional cup holder and a relatively large-diameter top portion to provide the necessary volume capacity. Some examples of this type of cup are disclosed in U.S. Pat. Nos. 5,433,337 and 5,657,897.

According to the present invention, a beverage cup comprises a large-diameter upper body providing a large capacity, a narrow-diameter base adapted to be received in a conventional vehicle cup holder, and a neck connecting the upper body to the base. The neck is formed to include an annular finger-receiving groove into which a user's finger is inserted to stabilize the cup during handling.

In preferred embodiments, the finger-receiving groove is positioned to lie closer to a bottom wall of the narrow-diameter base than to an upper edge of the large-diameter upper body. The vertical height of the large-diameter upper body is greater than the vertical height of the narrow-diameter base.

Also in preferred embodiments, the base is dimensioned such that the annular finger-receiving groove is positioned to lie above the upper surface of the cup holder when the cup is placed in a vehicle cup holder. The spacing between the finger-receiving groove and the upper surface of the cup holder is such that the finger-receiving groove naturally receives the ring finger of the user when the user grasps the cup to remove it from the cup holder.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

A large beverage cup 10 constructed in accordance with the present invention and well-suited for use in fast-food outlets to serve beverages such as soft drinks is shown, for example, in FIGS. 1–4. Cup 10 may be made from any suitable material, such as high density polyethylene (HDPE), polypropylene, styrene, or other suitable plastics material. In the preferred embodiment, cup 10 is made from high density polyethylene. Cup 10 may be provided with a removable lid (not shown) of a conventional construction.

Any suitable method known to those skilled in the art (such as injection molding, blow molding, vacuum forming, stretch molding, thermal molding etc.) may be used to manufacture cup 10. The injection molding method is preferred because it lends itself to high production rates with good dimensional accuracy.

Figure 3:
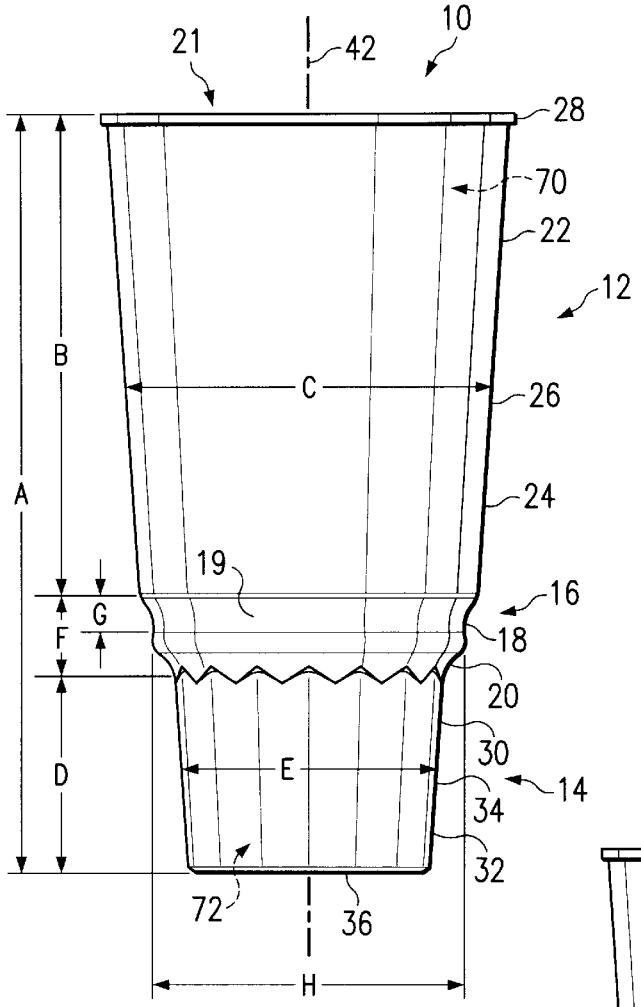
FIG. 3 is an elevational view of the beverage cup showing various dimensions of a presently preferred embodiment of the cup.
Figure 4:
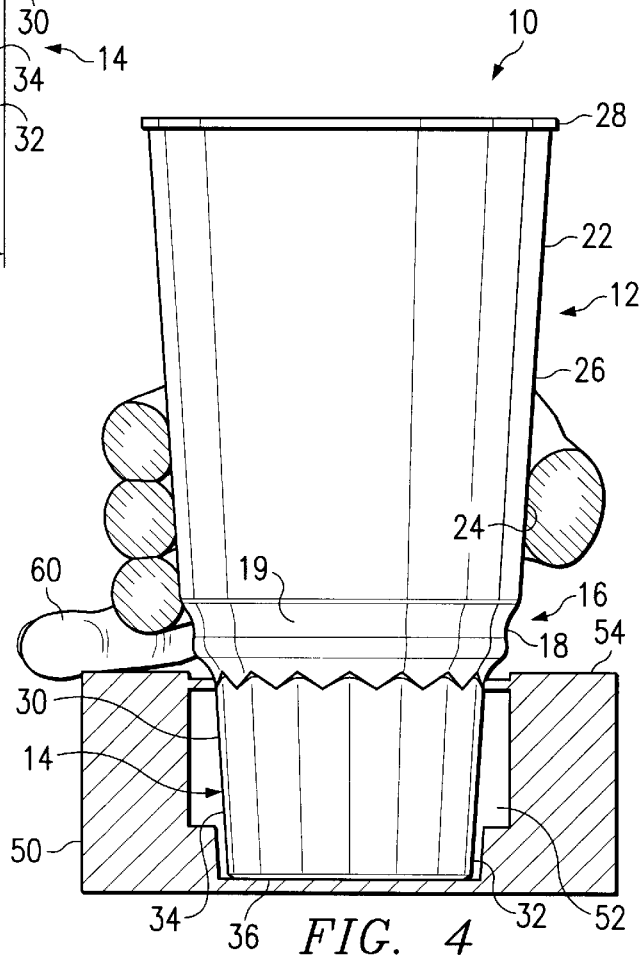
FIG. 4 is a view of the beverage cup received in a cup holder, shown in section, showing the annular finger-receiving groove being positioned to lie above the upper surface of the cup holder, a user's hand grasping the cup to remove it from the cup holder, and the ring finger of the user's hand being inserted into the finger-receiving groove.

As shown in FIGS. 3 and 4, cup 10 is formed as an integral body having an upper body portion 12, a lower body portion 14, and a neck portion 16 interconnecting upper and lower body portions 12, 14. Both upper body portion 12 and lower body portion 14 are generally conical and flare slightly from bottom to top (for example, between 3.855 to 4.500 degrees with respect to the vertical). Neck portion 16 extends axially upwardly and radially outwardly and serves to connect lower body portion 14 to upper body portion 12.

Figure 1:
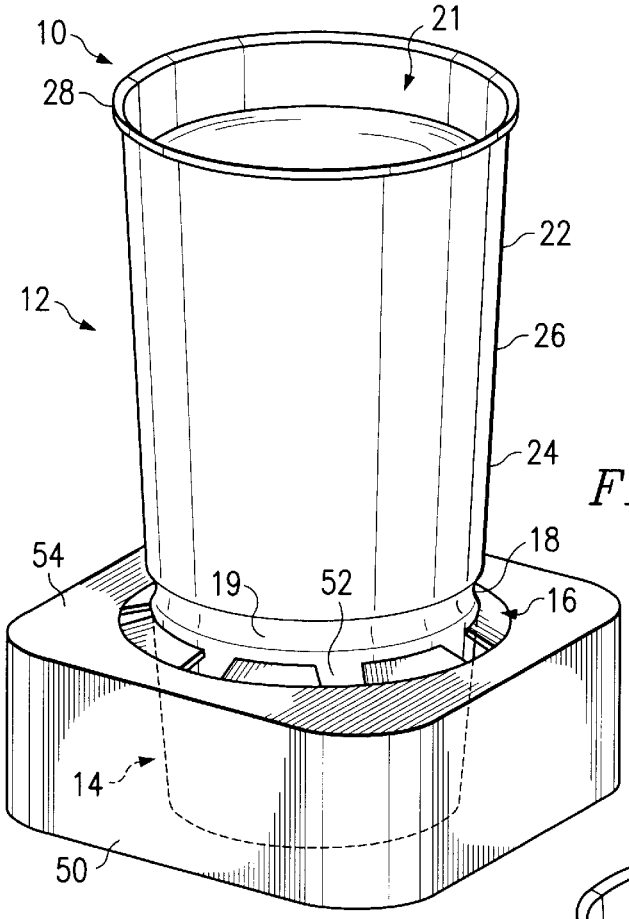
FIG. 1 is a perspective view showing a beverage cup constructed in accordance with the present invention and having a large-diameter upper body, a narrow-diameter base adapted to be received in a conventional vehicle cup holder, and a neck connecting the upper body to the base to form a beverage-receiving cavity and having an annular finger-receiving groove near to a bottom wall of the base.
Figure 2:
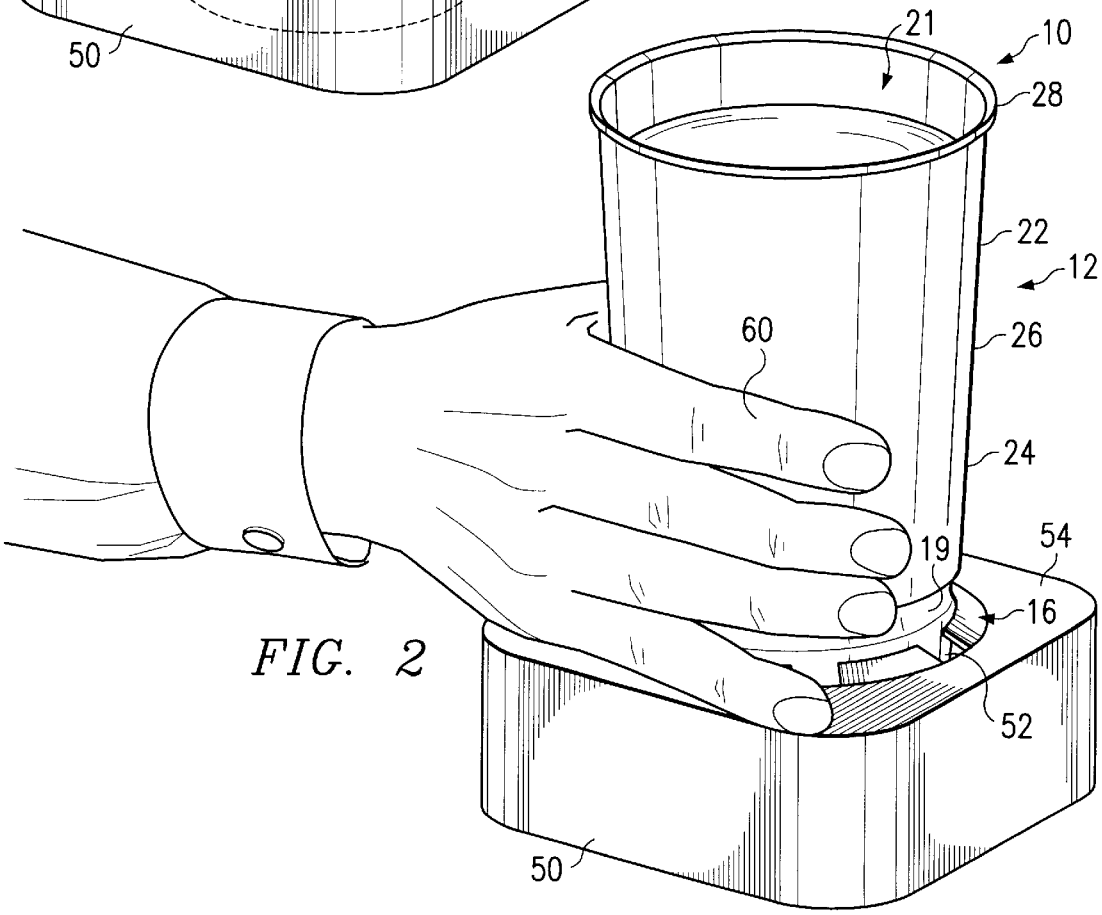
FIG. 2 is a perspective view similar to FIG. 1 and showing a user's hand grasping the cup to remove it from the cup holder, the ring finger of the user being inserted into the annular finger-receiving groove formed in the neck.
Figure 5:
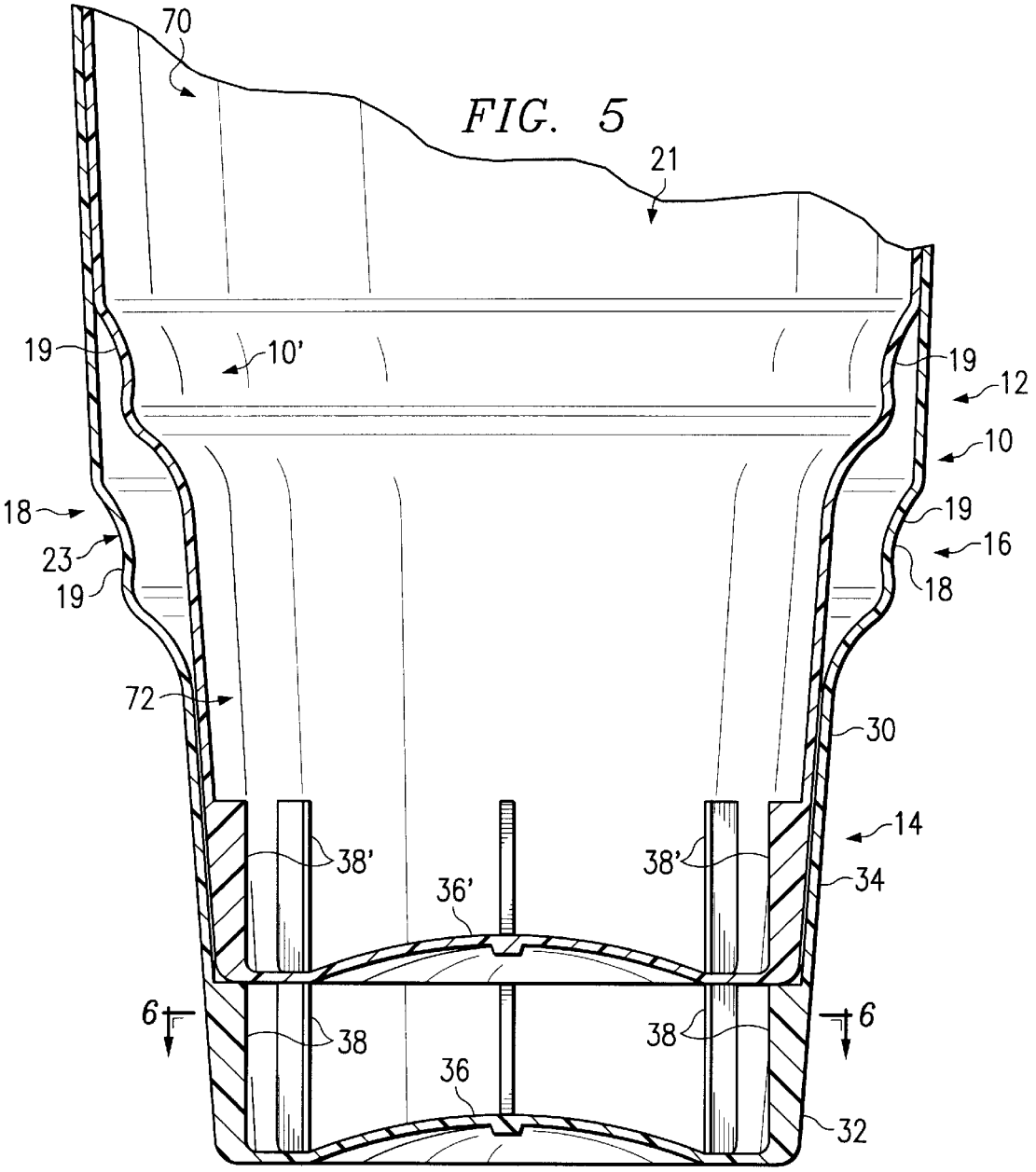
FIG. 5 shows a pair of beverage cups nested one within the other, with both cups shown in section.

Upper body portion 12, neck portion 16, and lower body portion 14 cooperate to define a beverage-receiving cavity 21 shown in FIGS. 1, 2, and 5. Cavity 21 has an open mouth defined by an upper edge 28 of upper body portion 12.

Neck portion 16 includes first and second transitional portions 18 and 20, which portions 18, 20 are positioned to lie in sequence between upper and lower body portions 12 and 14 as shown in FIG. 3. First transitional portion 18 forms a circumferential finger-receiving groove 19 that extends completely around an exterior surface of neck portion 16. Upper body portion 12 is considerably larger in diameter than lower body portion 14 and is also considerably taller than lower body portion 14 to accommodate a large quantity of drink (for example, 44.1 ounces) in cup 10. Lower body portion 14 is dimensioned to fit within a conventional cup holder 50 of the type commonly found in automobiles, boats, and other vehicles. These cup holders are typically of a size to receive a conventional twelve ounce aluminum can, about 2½ inches in diameter.

Upper body portion 12 has a top end 22, a bottom end 24, and an annular side wall 26. The top and bottom ends 22, 24 of the upper body portion 12 are open. Top end 22 presents an outwardly turned rim 28 at the mouth of cup 10.

Lower body portion 14 has a top end 30, a bottom end 32, an annular side wall 34, and a bottom wall 36. A plurality of short stacking ribs 38 project radially inwardly from the interior surface of annular side wall 34 as shown, for example, in FIGS. 5 and 6. Ribs 38 are positioned to lie adjacent to the bottom wall 36 of the cup 10 and are uniformly spaced apart around the circumference of lower body portion 14 such that the bottom wall 36' of another cup 10' can rest on the upper edges of the ribs 38 when two cups 10 and 10' are nested as shown in FIG. 5.

Figure 6:
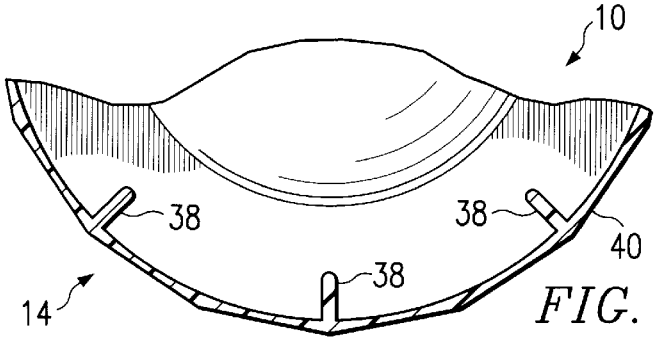
FIG. 6 is a partial sectional view of the beverage cup taken along line 6—6 in FIG. 5, and showing several of the flat side walls disposed around the exterior periphery of the narrow-diameter base.

Lower body portion 14 further includes a series of flat side walls 40 around its exterior periphery as shown, for example, in FIG. 6 to provide strength and support to lower body portion 14. Flat side walls 40 are preferably spaced equidistantly around the circumference of lower body portion 14 and may be present in any suitable number. In the particular embodiment depicted, there are sixteen flat side walls and the included angle defined between each pair of adjacent flat side walls is about 157.5°.

Referring now to a scale drawing of cup 10 in FIG. 3, a preferred embodiment of a cup 10 in accordance with the present invention has a height "A" of about 8.19 inches (20.8 cm), a first vertical distance "B" of about 5.21 inches (13.2 cm) between lower and upper edges of upper body portion 12, and a second vertical distance "D" of about 2.27 inches (5.76 cm) between bottom wall 36 and neck portion 16. Thus, the ratio of first vertical distance B to second vertical distance D is about 2.3:1. Neck portion 16 has a height "F" of about 0.71 inch (1.8 cm). A first region 70 of beverage-receiving cavity 21 is defined by and within upper body portion 12 to have a large volume of about 61 cubic inches (155 cubic cm) and a second region 72 of beverage-receiving cavity 21 is defined by and within lower body portion 14 to have a smaller volume (than upper body portion 12) of about 34 cubic inches (86 cubic cm). A third region of beverage-receiving cavity 21 is defined by and within neck portion 16 to place first region 70 in fluid communication with second region 72.

The nominal diameter "C" midway along distance B of upper body portion 12 is about 3.9 inches (9.9 cm) and the nominal diameter "E" midway along distance D of lower body portion 14 is about 2.8 inches (7.1 cm). The nominal diameter "H" (i.e., smallest diameter) of finger-receiving groove 19 in neck portion 16 is about 3.4 inches (8.6 cm). Thus, nominal diameter H of finger-receiving groove 19 is greater than nominal diameter E of lower body portion 14 and the ratio of nominal diameter H to nominal diameter E is about 1.2:1. The diameter of the opening of open mouth defined by rim 28 is about 4.29 inches (10.9 cm). The outside radius 23 of finger-receiving groove 19 in a plane containing longitudinal axis 25 of cup 10 is about 0.59 inch (1.5 cm).

FIGS. 1, 2, and 4 depict beverage cup 10 placed in a vehicle cup holder 50. Cup holder 50 is formed to include a cavity 52 for securely receiving lower body portion 14 of cup 10. Lower body portion 14 is dimensioned such that annular finger-receiving groove 19 is positioned to lie above an upper surface 54 of cup holder 50 when cup 10 is received in cup holder 50.

As illustrated in FIGS. 2 and 4, finger-receiving groove 19 is positioned in neck portion 16 adjacent to upper body portion 12 such that it naturally receives the ring finger 60 of the user when the user grasps the cup 10 to remove it from the cup holder 50. The annular finger-receiving groove 19 is dimensioned such that it receives substantially the entire palm side of a user's ring finger 60. By reason of its construction, and particularly the provision and location of annular finger-receiving groove 19 extending uninterruptedly around a ring-shaped exterior wall of neck portion 16, large-volume beverage cup 10 can be lifted easily out of vehicle or other cup holder 50 and returned to cup holder 50 without spilling. When cup 10 is full of liquid, it may be somewhat top heavy. Insertion of ring finger 60 into annular finger-receiving groove 19 serves to stabilize cup 10 and prevents it from tipping when the user lifts cup 10 out of cup holder 50. The insertion of ring finger 60 into annular finger-receiving groove 19 also serves to prevent cup 10 from slipping through the fingers when there is condensation on the outside surface of cup 10.

Variations on the embodiments described above are possible within the scope and spirit of the present invention. For example, cup 10 may have an octagonal cross section, instead of a circular cross section.

Although the present invention has been described in detail with reference to certain preferred embodiments, variations and modifications exist within the scope and spirit of the present invention as described and as defined in the following claims.

We claim:

1. A cup comprising a narrow-diameter bottom portion having an annular side wall and a bottom wall appended to the annular side wall, a large-diameter top portion having an annular side wall having an upper edge and a lower edge, a neck portion connecting the lower edge of the large-diameter top portion to the annular side wall of the narrow-diameter bottom portion, the top, neck and bottom portions cooperating to define a beverage-receiving cavity having an open mouth defined by the upper edge of the large-diameter top portion, the neck portion forming an annular finger-receiving groove sized to receive a user's ring finger to permit a user's hand to grasp around the neck portion while the user's finger extends into the finger-receiving groove so as to stabilize the top portion during handling, the finger-receiving groove located at a first vertical distance generally perpendicular to the bottom wall between the lower and upper edges of the large-diameter top portion being greater than a second vertical distance generally perpendicular to the bottom wall between the bottom wall and the neck portion to position the finger-receiving groove closer to the bottom wall than to the open mouth and wherein an outside radius of the finger-receiving groove in a plane containing the longitudinal axis of the cup is about 0.590 inch.

2. The cup of claim 1, wherein the annular finger-receiving groove extends uninterruptedly around a ring-shaped exterior wall of the neck portion.

3. The cup of claim 1, wherein the annular finger-receiving groove has a nominal diameter that is greater than a diameter of the bottom wall of the narrow-diameter bottom portion.

4. The cup of claim 1, wherein the annular finger-receiving groove has a nominal diameter that is greater than a nominal diameter of the narrow-diameter bottom portion and lesser than a nominal diameter of the large-diameter top portion.

5. The cup of claim 4, wherein the ratio of the nominal diameter of the annular finger-receiving groove to the nominal diameter of the narrow-diameter bottom portion is about 1.2:1.

6. The cup of claim 4, wherein the nominal diameter of the narrow-diameter bottom portion is about 2.8 inches (7.1 cm), of the large-diameter top portion is about 3.9 inches (9.9 cm), and of the annular finger-receiving groove is about 3.4 inches (8.6 cm).

7. The cup of claim 1, wherein the ratio of the first vertical distance to the second vertical distance is about 2.3:1.

8. The cup of claim 7, wherein the first vertical distance is about 5.2 inches (13.2 cm) and the second vertical distance is about 2.27 inches (5.76 cm).

9. The cup of claim 1, wherein a first region of the beverage-receiving cavity defined by the large-diameter top portion has a large volume, a second region of the beverage-receiving cavity defined by the narrow-diameter bottom portion has a small volume lesser than the large volume, and the ratio of the large volume to the small volume is about 1.8:1.

10. The cup of claim 9, wherein the large volume is about 61 cubic inches (155 cubic cm) and the small volume is about 34 cubic inches (86 cubic cm).

11. The cup of claim 1, wherein the bottom body portion is adapted to be received in a vehicle cup holder such that the annular finger-receiving groove is positioned to lie above and adjacent to an upper surface of the cup holder when the cup is received in the vehicle cup holder.

* * * * *